United States Patent [19]

Demarest

[11] 4,071,223

[45] Jan. 31, 1978

[54] FENCES AND NOISE BARRIERS

[76] Inventor: Vincent Demarest, 19 Mill Lane, Benson, Oxfordshire, England

[21] Appl. No.: 680,482

[22] Filed: Apr. 26, 1976

[30] Foreign Application Priority Data

| | | |
|---|---|---|
| Apr. 26, 1975 | United Kingdom | 17409/75 |
| Oct. 18, 1975 | United Kingdom | 42873/75 |

[51] Int. Cl.[2] ..... E04H 17/00

[52] U.S. Cl. ..... 256/1; 256/65; 256/24; 181/210

[58] Field of Search ..... 256/13.1, 19, 24, 59, 256/65, 1, 73; 181/33 HE, 33 G

[56] References Cited

U.S. PATENT DOCUMENTS

| | | | |
|---|---|---|---|
| 2,564,866 | 8/1951 | Tassel | 256/19 |
| 3,648,981 | 3/1972 | Allen | 256/59 |

FOREIGN PATENT DOCUMENTS

| | | | |
|---|---|---|---|
| 228,823 | 8/1963 | Austria | 256/13.1 |
| 904,547 | 8/1962 | United Kingdom | 256/24 |
| 590,047 | 7/1947 | United Kingdom | 256/19 |
| 1,417,891 | 12/1975 | United Kingdom | 256/13.1 |

*Primary Examiner*—Andrew V. Kundrat
*Attorney, Agent, or Firm*—Young & Thompson

[57] ABSTRACT

A noise barrier fence includes vertical eye section steel upright posts each presenting open channels facing along the length of the fence, horizontal rails located in these open channels and vertical boards fastened to the horizontals, the boards being butted side by side with the joints covered by small overlapping cover strips. The vertical boards also fit into the channels of the upright posts and their upper and lower ends are sandwiched between pairs of horizontal boards at the top and bottom of the fence. The construction is readily adapted to sloping ground and effectively closes all gaps through the fence.

9 Claims, 12 Drawing Figures

FENCES AND NOISE BARRIERS

Figure 1:
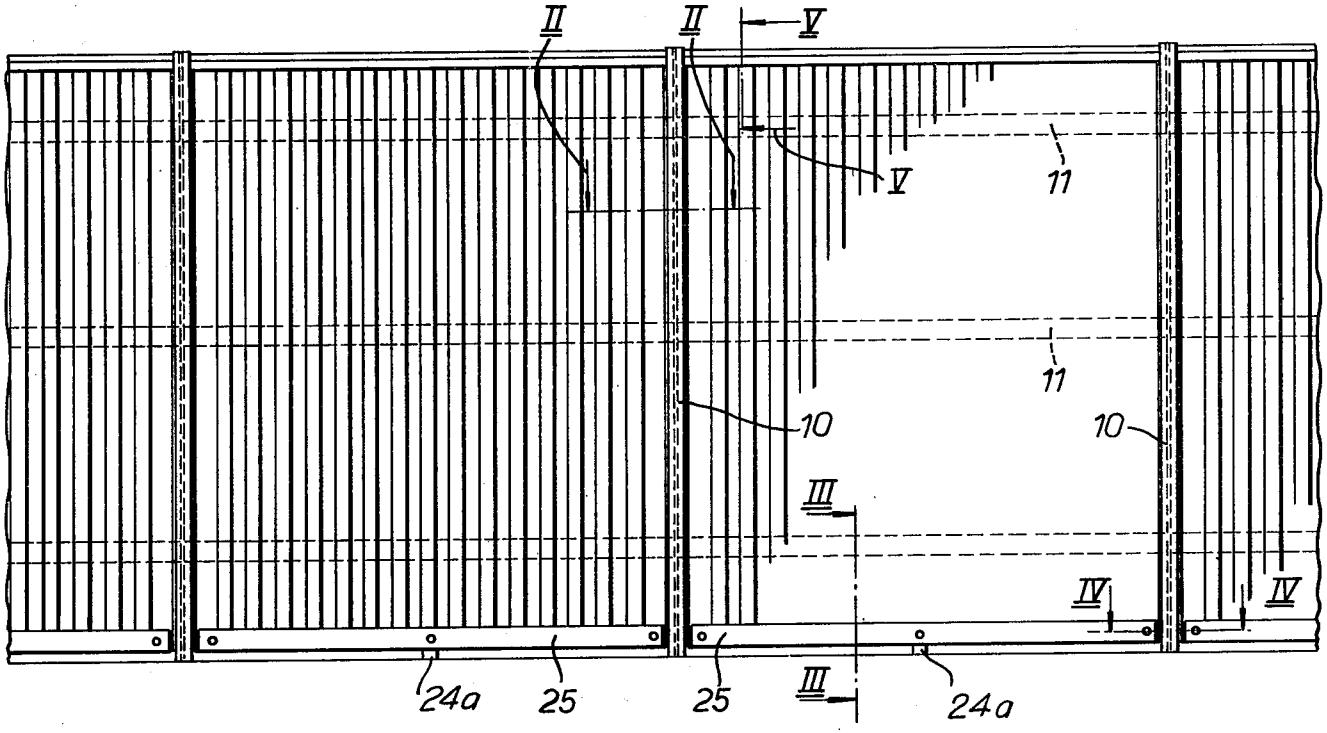

This invention is concerned particularly, though not exclusively, with noise barriers as used for example on motorways, around aerodromes, or elsewhere to reduce the noise level particularly in adjacent residential areas. It is an object of the invention to provide an improved noise barrier fence which will facilitate construction and erection and avoid excessive costs while maintaining a satisfactory degree of noise prevention or absorption.

Broadly stated from one aspect the invention consists in a barrier including a number of spaced upright posts, with inter-connecting horizontal rails and vertical pales or boards, in which the upright posts each have troughs or grooves formed in oppoiste faces directed along the length of the fence, and the ends of the horizontal rails and the edges of adjacent pales or boards fit into these troughs or grooves.

Conveniently the upright posts are rolled steel I-sections, and preferably the ends of the horizontal rails and the edges of adjacent pales or boards are a tight fit in the open troughs or grooves of the posts.

From another aspect the invention consists in a barrier including a number of spaced upright posts with interconnecting horizontal rails and vertical pales or boards, in which the pales or boards ae arranged closely adjacent side by side and non-overlapped and at each joint between two pales or boards a cover strip is fixed and secured by fastenings passing through the joint.

Preferably the cover strips are secured by means of ring shank nails or the like, and conveniently each cover strip is of the same thickness as the main pales or boards but of lesser width.

From another aspect the invention consists in a barrier comprising a number of spaced upright posts with interconnecting horizontal rails and vertical pales or boards, in which the lower ends of the pales or boards are sandwiched between a pair of horizontal rails or "gravel boards" running along the bottom of the fence on opposite sides.

Preferably the two rails or gravel boards on opposite sides of the barrier are of slightly different heights, to create overlap for more effective sound sealing, and in a particular preferred construction the posts are formed with vertical grooves or troughs and the ends of the two gravel boards fit into the said groove or trough at each end.

From another aspect the invention consists in a barrier comprising a number of spaced upright posts with interconecting horizontal rails and vertical pales or boards, in which the upper ends of the boards are received in a cap structure comprising a horizontal flange overlying the tops of the pales and vertical flanges extending along both opposite faces thereof.

The capping member may be secured at each end to the respective upright post by means of a bracket.

From yet another aspect the invention consists in a fence including a number of spaced upright posts, with interconnecting horizontal rails to which are attached vertical pales or boards, in which the upper ends of the vertical pales or boards are located between a pair of separate spaced generally horizontal strips, closed by a cover strip, to conceal the upper edges of the individual pales or boards.

Figure 2:
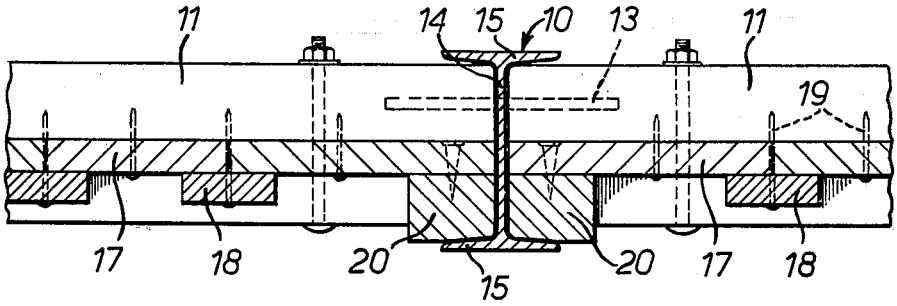
Figure 3:
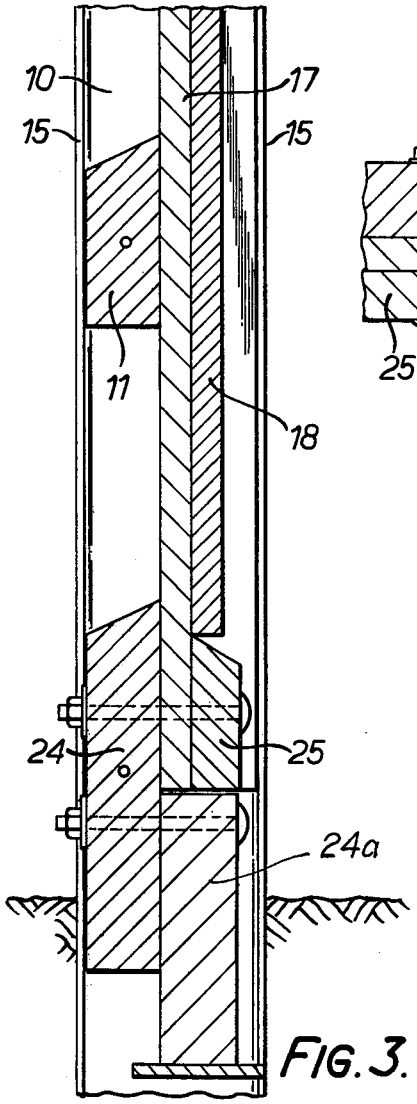
Figure 4:
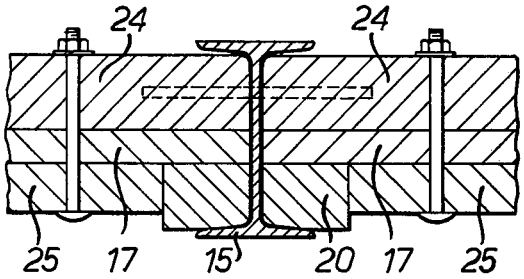
Figure 5:
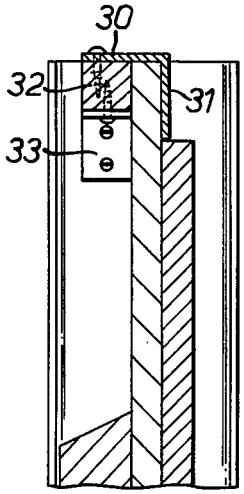
Figure 4A:
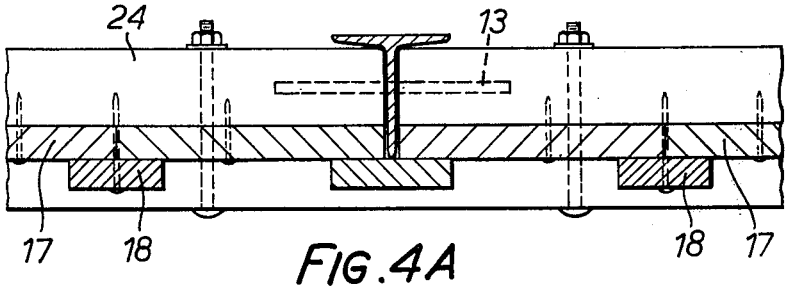
Figure 6:
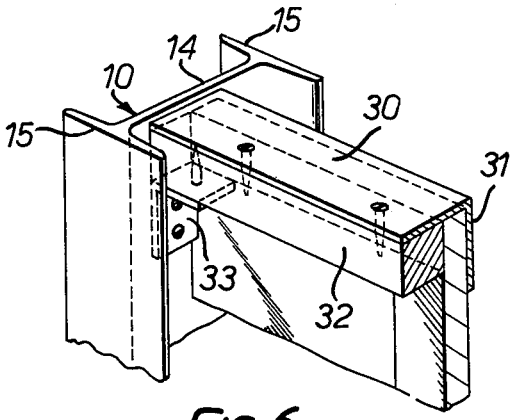
Figure 8:
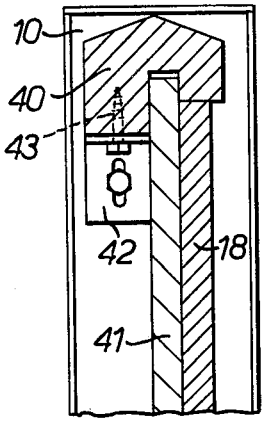
Figure 6A:
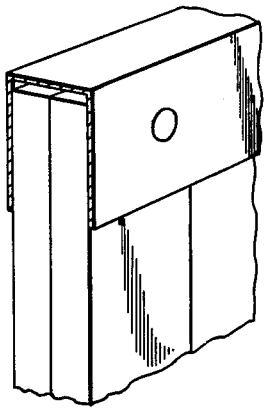
Figure 7:
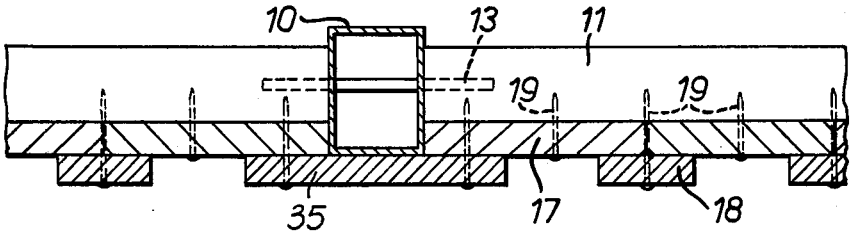
Figure 9:
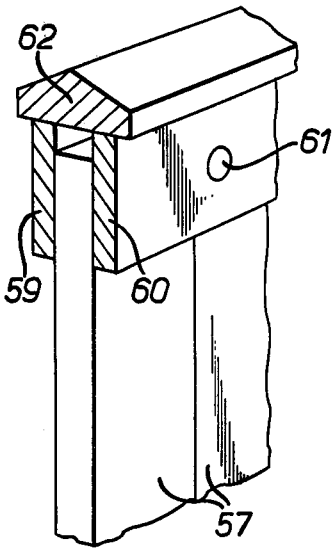
Figure 10:
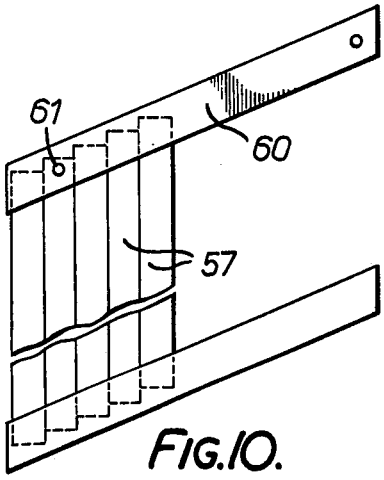

The invention may be performed in various ways and one specific embodiment with a number of possible modifications will now be described by way of example with reference to the accompanying drawings, in which:

FIG. 1 is a general front elevation of a barrier according to the invention,

FIG. 2 is a sectional plan view through the barrier on the line II—II in FIG. 1, FIG. 3 is a vertical section through the lower part of the barrier on the line III—III in FIG. 1, FIG. 4 is a sectional plan view through the lower part of the barrier on the line IV—IV in FIG. 1, FIG. 4A is a view similar to FIG. 4 illustrating an alternative using T-section uprights, FIG. 5 is a sectional elevation through the upper part of the barrier on the line V—V in FIG. 1, FIG. 6 is a scrap perspective view showing a detail of this upper capping rail construction, FIG. 6A is another perspective sectional view which shows an alternative "U" section capping rail, FIG. 7 is a sectional plan view illustrating an alternative form of upright and board arrangement according to the invention, FIG. 8 is a view similar to FIG. 5 illustrating an alternative construction of timber capping piece, FIG. 9 is a perspective view illustrating a detail of the top capping assembly of another form of fence according to the invention, and FIG. 10 is a somewhat diagrammatic side elevation showing the top and bottom profiles of such a fence on a slope.

Referring first to FIGS. 1 and 2, the barrier comprises a series of spaced vertical uprights 10, each formed as a rolled steel I-section which may be coated with hard PVC over a phosphate undercoat or galvanised. Timber horizontal rails 11 are located between the uprights with the ends of these rails fitting into the open troughs of the uprights, the timber rails being secured by means of stainless steel dowels 13 tightly fitting into holes drilled in the ends of the rails and passing through corresponding holes in the webs 14 of the uprights. The timber rails themselves are narrower than the distance between the flanges 15 of the upright posts, for a purpose to be described.

Secured to the front faces of the horizontal rails 11 are a series of vertical timber boards 17, closely positioned side by side and secured by nails 19 driven into rails. These nails may be ring shank nails for maximum strength and security. There is a risk that a gap may open up at each joint between a pair of pales as a result of shrinkage, and accordingly a vertical timber cover strip 18 is positioned over each joint and secured by ring shank nails 19 passing through the joint between the boards 17 into the timber rail 11. The thickness of each cover strip is preferably the same as that of the pales, i.e. in the present instance ¾ inch, so that even if a gap opens between the pales there is still a full ¾ inch thickness of timber acting as a noise barrier.

Where the rails and pales fit into the troughs or slots formed by the upright posts, specially shaped timber packing elements 20 are placed in position to form a sealant to prevent noise penetrating through any gap between the boards and the metal posts. These packing elements are secured by screws to the boards.

Along the bottom edge of the fence the timber pales are sandwiched between a pair of rails or "gravel boards" 24,25 and as illustrated in FIGS. 3 and 4 the ends of these gravel boards are fitted into the troughs formed by the rolled steel posts 10 and bolted in position between the flanges 15. Alternatively the gravel boards may be secured by means of steel dowels similar to the dowels 13. The cover strips 18 are preferably not included in the sandwich gravel board construction since this would leave gaps through which noise might penetrate. The two gravel boards 24,25 are of slightly different heights and the overlap provided helps to reduce any risk of noise penetrating the fence in this region. Each of the gravel boards 24 is also supported at an intermediate point in its length by a short stub 24*a*, as illustrated in FIGS. 1 and 3. An advantage of this sandwich construction is that the bottom ends of all the pales are fully concealed and therefore it is possible to provide a smooth contoured fence following the contours of the ground without the need for cutting the bottoms of the pales on site to suit the sloping ground levels. This eliminates the need for "stepping" posts and panels which is necessary with square ended boards and normal gravel boards.

At the upper edge of the fence the top ends of the timber pales are located in a capping member construction which may be of timber, or may include a steel angle section 30 as illustrated in FIGS. 5 and 6, with one flange 31 lying over the front face of the pales to create a deep lip and the other horizontal flange protecting their upper edges. Alternatively a U-section capping rail may be used as illustrated in FIG. 6A. A timber fillet 32 is secured to this top flange 30 and bears against the opposite face of each board. The capping member is secured to each upright 10 by means of a metal angle bracket 33 which may be bolted to the web 14 of the upright and nailed to the timber fillet 32. In fact the top and bottom end of each pale is concealed and therefore accurate cutting to length is unnecessary.

FIG. 7 illustrates an alternative construction where the upright posts 10 are hollow rectangular steel box sections, and in this case the joints between the pales 17 are again covered by strips 18, and at the posts themselves by cover boards 35, which overlap the joints alongside the posts where shrinkage might cause gaps to appear.

FIG. 8 illustrates an alternative construction of a timber capping piece or rail 40, grooved to fit over the upper edges of the main boarding 41, and located by angle brackets 42 at each upright post, secured by coach screws 43.

One of the advantages of the barriers described is that they can be readily contoured to match slopes or irregularities in the ground. Most barrier fences, particularly when prefabricated, need to be installed with vertical uprights and the top edges of each section of the fence horizontal, thus producing a stepped top profile. This is unattractive and the same stepped result, of course, occurs along the bottom edges of the fence sections which creates serious practical difficulties in closing the gaps, especially when the fence is designed as a noise barrier, since the noise may escape underneath the fence. In the embodiment described above, each fence section between uprights can be profiled to suit the slope of the ground, and this object can also be achieved in other ways.

The barrier illustrated in FIGS. 9 and 10 has a number of close parallel upright pales 57 secured to the supporting framework of uprights and horizontals, with the gaps between adjacent pales overlapped by cover strips (not shown). In this embodiment the top capping assembly along the upper edge of each fence section is formed by two separate horizontal timber strips 59,60 located on opposite sides of the pales 57 to form a sandwich and secured by transverse bolts 61. A shaped capping rail 62 is secured across the upper edges of the two strips 59,60 and acts to provide an attractive appearance and as a weather shield. As illustrated in FIG. 10 the capping assembly conceals the upper ends of the individual pales which are, of course, stepped if the fence section is constructed on a slope. The gravel boarding construction at the lower edge of the barrier is as described previously with a pair of boards one on each side sandwiching the lower ends of the pales. Here again the bottom edges of the individual pales are stepped but are concealed between the gravel boards and this permits the bottom edge of the fence to match the slope of the ground without gaps.

The larger gravel board is buried 2 inches into the ground. This unit can be manufactured in reinforced concrete if preferred, the smaller one can be timber or steel.

It will be noted that the constructions described and illustrated have a number of very desirable features of special advantage in a noise barrier. Firstly, these constructions effectively satisfy the requirement that no splits or gaps should be allowed to occur between the various members and components of the barrier, which would allow sound to penetrate. Secondly, the preferred constructions fulfil the requirment that all four edges of each section of the barrier should be effectively sealed against sound penetration, i.e. the top and bottom edges where the pales are connected to the horizontal rails or boards or capping pieces, and secondly the meeting of the vertical edges of each section with the upright posts.

Since noise barriers on motorways for example may be up to 4 meters in height it is important to obtain a synthetic blend with the envionment and an important feature of these illustrated constructions is the ability to conform to the slope of the contours of the ground without resorting to a "stepped" barrier fence as is normal practice. To conform to the slope of the ground is in many barriers a major problem.

Furthermore, it will be noted that since both the top and bottom ends of the boards or pales are effectively contained, sealed and concealed inside the special top capping and the sandwich gravel boards at ground level, there is no need for all the boards to be cut exactly to length, nor to be individually cut to suit the slope. Any unsightly stepping of the top and bottom edges of individual boards is fully concealed and also effectively sealed against noise, thus providing a double advantage.

I claim:

1. A barrier including a number of spaced upright posts, with inter-connecting horizontal rails and vertical boards, in which each of the upright posts is an integral rolled steel member of I-section providing grooves in opposite faces directed along the length of the fence, and the ends of the horizontal rails and the edges of adjacent boards, together with further vertical packing elements, are tightly fitted into the said grooves.

2. A barrier comprising a number of spaced upright posts with interconnecting horizontal rails and vertical boards, in which the lower ends of the boards are sandwiched between a pair of horizontal gravel boards extending along the bottom of the fence on opposite sides thereof, the said two boards being of different heights.

3. A barrier comprising a number of spaced upright posts with interconnecting horizontal rails and vertical boards, in which the lower ends of the boards are sandwiched between a pair of horizontal gravel boards extending along the bottom of the fence on opposite sides thereof, and the said posts are formed with vertical grooves in opposite faces extending in the direction of the fence and the ends of one of the said two gravel boards fit into the respective grooves.

4. A fence comprising a number of spaced upright posts with interconnecting horizontal rails and vertical boards, in which the upper ends of the said boards are received in a cap structure comprising two vertical flanges extending respectively along the opposite faces of the upper ends of said boards, the said flanges being of different vertical heights, and a unitary horizontal flange overlying the tops of the boards and being integral with said vertical flanges.

5. A fence according to claim 4, in which the cap structure comprises an angle section rail with a horizontal flange overlying the tops of the boards, and a vertical flange extending along one of the faces thereof, and a separate fillet secured below the said horizontal flange and lying along the opposite faces of the boards.

6. A fence according to claim 4 in which the cap structure is secured at each end to the respective upright post by means of a bracket.

7. A barrier including a number of spaced upright posts with interconnecting horizontal rails and vertical boards, in which the boards are arranged closely adjacent side by side in non-overlapping relationship and at each joint between two boards a cover strip is secured by fastenings passing through the said joint between the said two boards.

8. A barrier according to claim 7, in which the said boards and the cover strips are secured by means of nails, bolts or the like.

9. A barrier according to claim 7, in which each cover strip is of the same thickness as the main boards but of lesser width.

* * * * *